US005957212A

United States Patent [19]

Sundholm

[11] Patent Number: 5,957,212

[45] Date of Patent: Sep. 28, 1999

[54] INSTALLATION FOR FIGHTING FIRE

[76] Inventor: Göran Sundholm, Ilmari Kiannon kuja 3, FIN-04310 Tuusula, Finland

[21] Appl. No.: 08/852,558

[22] Filed: May 7, 1997

Related U.S. Application Data

[62] Division of application No. 08/325,382, filed as application No. PCT/FI93/00181, Apr. 28, 1993, Pat. No. 5,687,796.

[30] Foreign Application Priority Data

Apr. 29, 1992 [FI] Finland ..... 921937

[51] Int. Cl.[6] ..... A62C 35/58

[52] U.S. Cl. ..... 169/54; 169/16; 169/37; 169/91; 239/428.5; 454/342

[58] Field of Search ..... 169/5, 16, 37, 169/54, 91; 459/342, 344, 341; 239/428.5

[56] References Cited

U.S. PATENT DOCUMENTS

| | | | |
|---|---|---|---|
| 2,436,038 | 2/1948 | Farrell | 454/342 |
| 2,586,797 | 2/1952 | Dunlop et al. | 169/2 |
| 2,935,135 | 5/1960 | Grant | 454/342 |
| 3,884,304 | 5/1975 | Messerschmidt et al. | 169/91 |
| 4,703,808 | 11/1987 | O'Donnell | 169/54 |
| 4,765,231 | 8/1988 | Aniello | 98/33.1 |
| 4,779,801 | 10/1988 | O'Donnell | 169/91 |
| 4,986,364 | 1/1991 | Clark | 169/48 |
| 5,014,790 | 5/1991 | Papavergos | 169/2 |
| 5,253,716 | 10/1993 | Mitchell | 169/16 |
| 5,396,960 | 3/1995 | Marcott et al. | 169/54 |

FOREIGN PATENT DOCUMENTS

| | | |
|---|---|---|
| 2410761 | 3/1974 | Germany . |
| 1382480 | 3/1988 | U.S.S.R. . |
| 1513326 | 10/1989 | U.S.S.R. . |

*Primary Examiner*—Gary C. Hoge
*Attorney, Agent, or Firm*—Ladas & Parry

[57] ABSTRACT

The object of the invention is to provide a new installation for fighting fire, which is effective in restricting damages caused by smoke generation. A sprinkler (6) or a spray head is arranged in or at an air passage (7) in such a way that when the spinkler is activated it creates a suction from the fire space (1) into the air passage.

8 Claims, 2 Drawing Sheets

INSTALLATION FOR FIGHTING FIRE

This is a divisional of application Ser. No. 08/325,382 filed on Dec. 6, 1994 now U.S. Pat. No. 5,687,796 and International Application PCT/FI93/00181 filed on Apr. 28, 1993 and which designated the U.S.

BACKGROUND OF THE INVENTION

The present invention relates to an installation for fighting fire, comprising at least one sprinkler, or spray head, in connection with a monitored space.

In most kinds of fires the generation of smoke causes extensive damages and losses of human lives, especially in apartment fires and fires in hotel rooms and in ship cabins.

The object of the invention is to provide a new installation for fighting fire, which better than earlier known installations is capable of restricting damages caused by smoke generation.

SUMMARY OF THE INVENTION

The present invention provides an installation for fighting fire having at least one sprinkler or spray head associated with a monitored space. The at least one spray head or sprinkler is arranged upon activation to create a suction through an opening into an air passage out of the monitored space by spraying liquid in the form of small droplets, like a fog, into the air passage. The air passage is in communication with at least one further opening into the monitored space so that the at least one spray head into the air passage, the air passage further, when activated, produces a suction having drain or sprinkler for draining the liquid and an impact arrangement for being impacted by the small droplets and directing the impacted droplets to the drain.

Preferably, the air passages leads to a ventilation duct.

In a preferred embodiment, the impact arrangement is a closed end of a channel formed in the air passage and positioned in the direction of the spray of droplets.

In an alternative embodiment, the impact arrangement is a bend formed in the air passage.

Sprinklers or spray heads adaptable to the present installation are presented in the International Patent Application PCT/FI92/00155, Publication Number WO92/20453. By a high drive pressure is here meant a pressure range of about 20 bar to about 200 bar, as compared to about 6 bar to 10 bar for conventional sprinkler installations. The diameter of the droplets are typically within the range 50–150 microns.

Said at least one sprinkler or spray head is preferably governed by a smoke detector, in order to suck out smoke at the very beginning of a fire, even before actual fire extinguishing has been commenced.

When the sprinkler or spray head is activated after a fire has started, a suction is produced in said air passage, e.g an air channel, so that smoke generated by the fire is sucked into the channel via one at least one second opening into the monitored space and flows through the channel and out at the sprinkler or spray head, the smoke thus being intermixed with the extinguishing liquid. The smoke is thereby cooled and at least partly washed by the extinguishing liquid.

The purifying of the smoke gases can be effected by arranging a filter in the air channel.

To utilize ordinary ventilation ducts for exhaustion of smoke may be of advantage in particular in ships and hotels.

BRIEF DESCRIPTION OF THE DRAWINGS

In the following the invention shall be described with reference to exemplifying embodiments shown in the attached drawing.

FIG. 1 shows a cabin or room 140 with a sprinkler 141 mounted on the wall above a door. A channel 142 leads from the ceiling to the open air, with a spray head 143 mounted at the outer end of the channel. The spray head 143 is activated, through a valve 144 preferably governed by a smoke detector not shown, and creates a suction in the channel 142 to exhaust smoke from the room 140.

FIG. 2 shows an alternative embodiment, with a ceiling sprinkler 151 of the kind as presented in the International Patent Application PCT/FI92/00213, Publication Number WO93/100962. When activated (e.g., in the same way as presented in the international Patent application PCT/FI92/00316, Publication number WO93/10860), the sprinkler 151 passes liquid through its branch to a spray head 153 which creates a suction in a channel 152 and thus exhausts smoke from a room 150.

Figure 1:
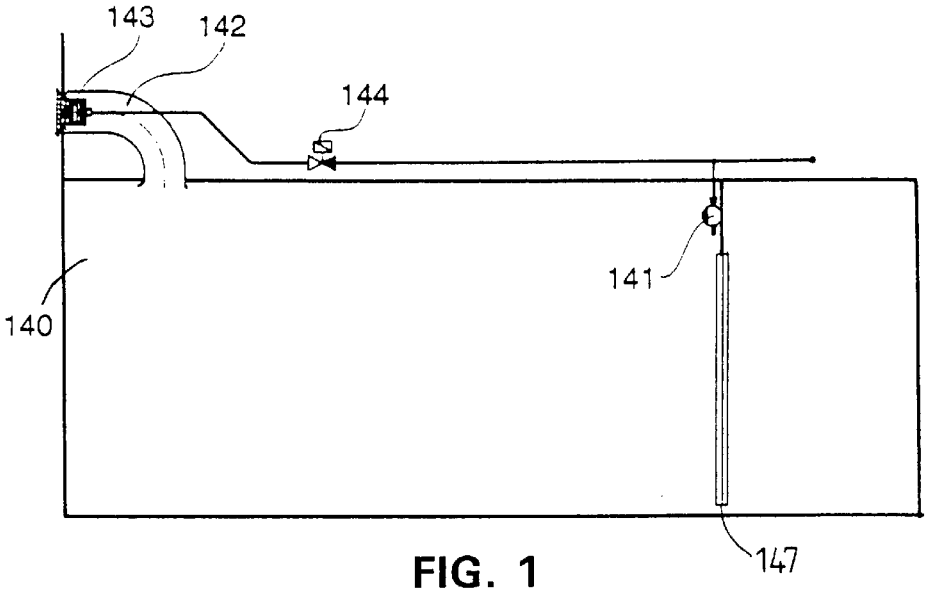
FIGS. 1, and 2, and 3 show three installations for fighting fire show three in connection with a ship cabin or hotel room.
Figure 2:
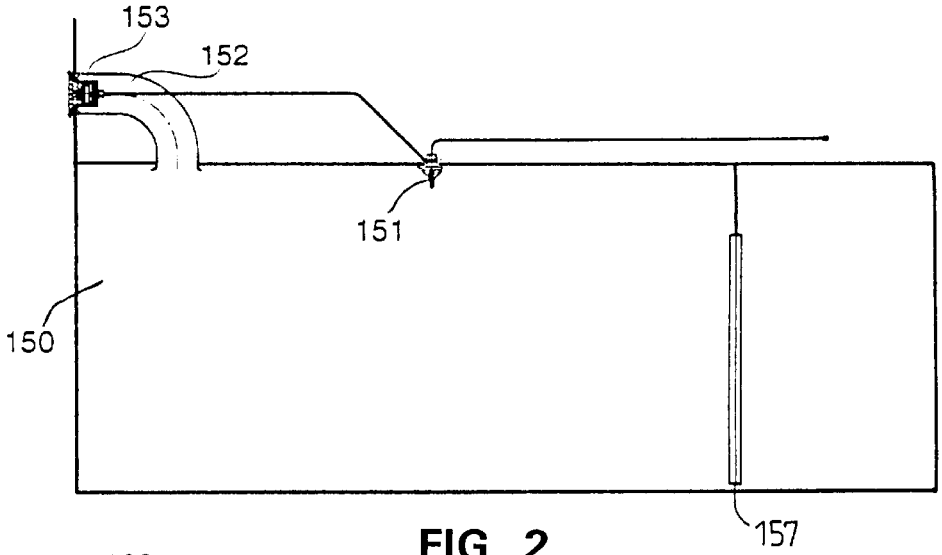
Figure 3:
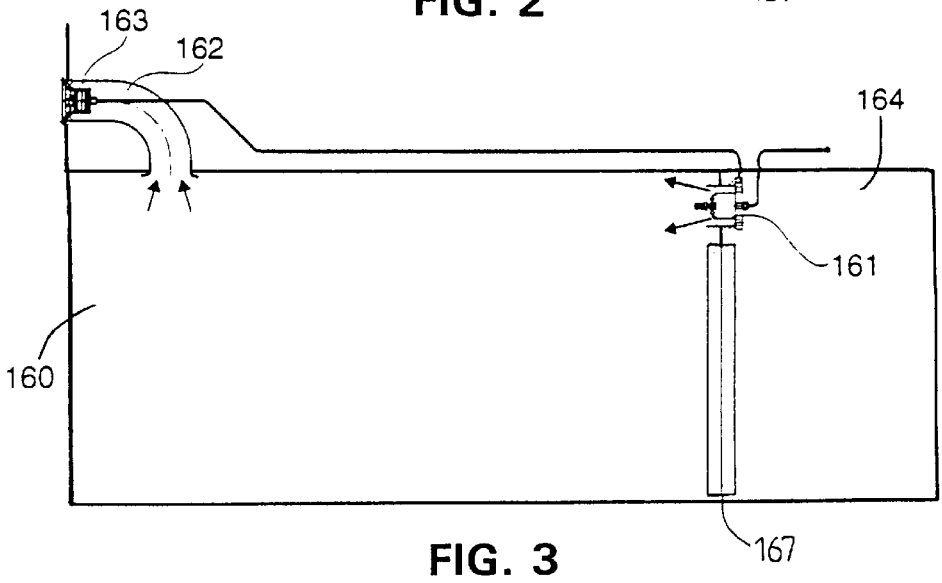

In a further alternative embodiment according to FIG. 3, a sprinkler 161 is mounted in a wall opening leading from a room to a corridor 164. A spray head 163 is activated by the sprinkler 161, in principle in the same manner as in FIG. 2, and sucks smoke out of the room 160 through a channel 162. Air is also sucked in from the corridor 164 past the sprinkler 161.

Figure 4:
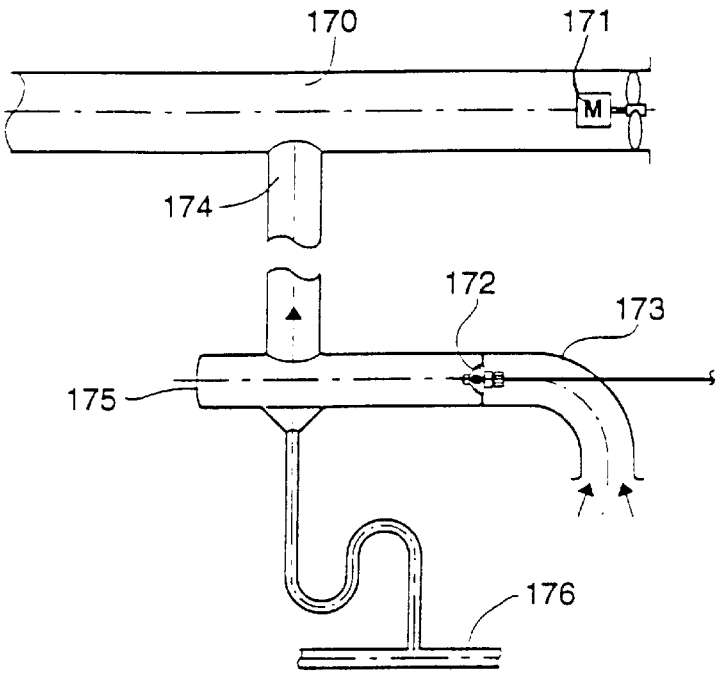
FIGS. 4 and 5 show two alternative embodiments of the invention for smoke exhaustion in combination with liquid recovery.
Figure 5:
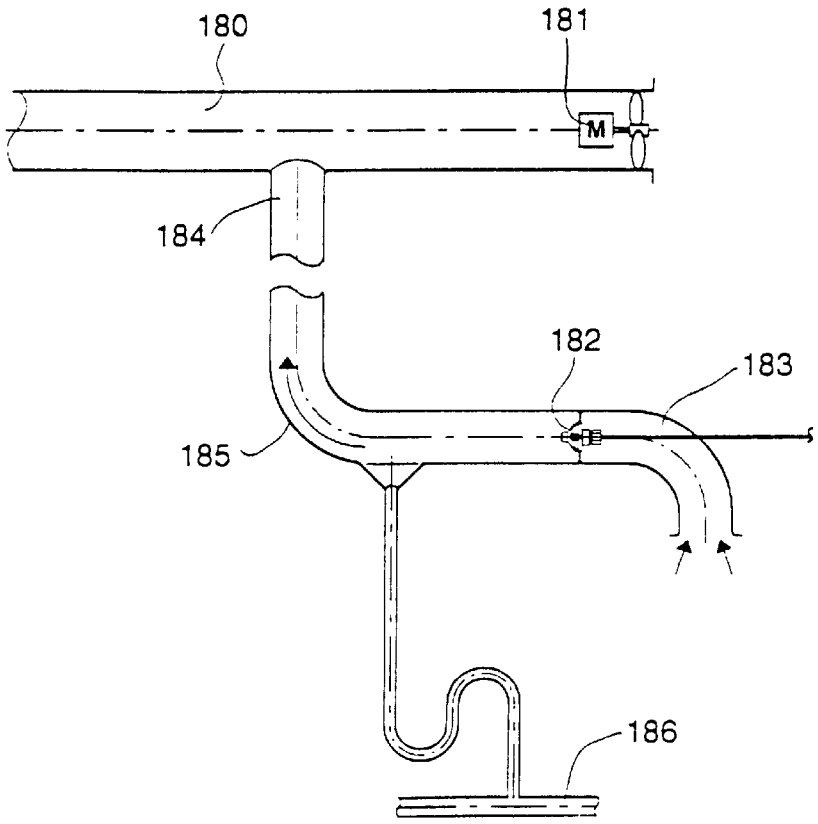

It is not always possible to arrange that a spray head 143 or sprinkler which is intended to create a suction out of a room 140 in such a way that the liquid is sprayed out into the open air; sometimes the liquid is sprayed into regular ventilation ducts or the like. FIGS. 4 and 5 show two embodiments for preventing liquid from entering a ventilation duct 170, 180 and for recovering a major part of the liquid.

A ventilation duct with an ordinary fan are indicated by 170 and 180, respectively, and 171 and 181, respectively. A spray head 172 and 182, respectively sucks smoke into a channel 173 and 183, respectively. In FIG. 4, the channel 173 has a closed end 175 and at a short distance from the closed end 175 a connection channel 174, preferably essentially perpendicular to the suction channel 173, leads to the ventilation duct 170. The liquid drops stop against the closed channel end 175 and most of the liquid flows down into a draining pipe 176. In FIG. 5, the liquid drops hit a bend 185 before a connection channel 184 to the ventilation duct 180, and most of the liquid flows down into a draining pipe 186. A sprinkler generally has a release element, e.g. a glass ampoule reactive to heat or smoke, whereas a spray head need not have a release element of its own; it can be e.g. remote controlled.

FIG. 5 shows schematically one embodiment for such a case. Sprinklers are indicated by 190, smoke detectors/heat detectors are indicated by 191 and smoke exhaustion ducts are indicated by 192. The sprinklers 190 are preferably, but not necessarily arranged to be released in groups, e.g. as presented the International Patent Application PCT/FI92/00316. Adjacent groups overlap each other, i.e. a border row of sprinklers belong to two groups.

Smoke exhaustion is preferably arranged to activated in a similar group release manner, that is, when any smoke detector reacts, it activates e.g. the four nearest surrounding smoke exhaustion ducts 192 in any of the ways described earlier.

In many, probably most installations here are contemplated. It is preferable to arrange the system to be at least partially automatically released. The invention is not, however, restricted to automatically operating installations; e.g. of installations in engine rooms in ships a possibility for manual operation is generally required.

The invention can also be utilized in a reverse manner, that is, the monitored space can be the open air, for purifying intake air from contaminations, e.g. radioactive contaminations. The embodiment of FIGS. 4 and 5 are useful for that purpose. In particular, all types of shelter rooms and military vehicles or vessels have a potential need for such installations.

I claim:

1. An installation for fighting a fire, comprising:

an air passage (173, 183) from an opening from a space;

at least one sprinkler or spray head means (172; 182) for creating, upon activation, a suction out of said space into said opening and air passage by spraying liquid in the form of small droplets, like a fog, into said air passage (173, 183);

drain means (176, 186) for draining said liquid; and impact means (175, 185) positioned in said air passage for being impacted by said small droplets and directing said impacted droplets to said drain means.

2. The installation as claimed in claim 1, wherein said air passage (173, 183) leads to a ventilation duct (170, 180).

3. The installation as claimed in claim 1, wherein said sprinkler or spray head has a release element reactive to heat.

4. The installation as claimed in claim 1, wherein said sprinkler or spray head has a release element reactive to smoke.

5. The installation as claimed in claim 1, wherein said impact means is a closed end (175) of said air passage (173).

6. The installation as claimed in claim 5, wherein said drain means is a draining pipe (176) having an opening between said sprinkler or spray head (172) and said closed end (175).

7. The installation as claimed in claim 1, wherein said impact means is a bend (185) in said air passage (183).

8. The installation as claimed in claim 7, wherein said drain means is a draining pipe (186) having an opening between said sprinker or spray head (182) and said bend (185).

* * * * *